US009944429B1

(12) United States Patent
Whidden

(10) Patent No.: US 9,944,429 B1
(45) Date of Patent: Apr. 17, 2018

(54) SHIPPING CRATE

(71) Applicant: William L. Whidden, Orlando, FL (US)

(72) Inventor: William L. Whidden, Orlando, FL (US)

( * ) Notice: Subject to any disclaimer, the term of this patent is extended or adjusted under 35 U.S.C. 154(b) by 0 days.

(21) Appl. No.: 15/158,939

(22) Filed: May 19, 2016

Related U.S. Application Data

(60) Provisional application No. 62/163,551, filed on May 19, 2015.

(51) Int. Cl.
*B65D 19/00* (2006.01)
*B65D 8/00* (2006.01)
*B65D 43/02* (2006.01)

(52) U.S. Cl.
CPC ..... *B65D 15/24* (2013.01); *B65D 15/22* (2013.01); *B65D 19/0012* (2013.01); *B65D 43/02* (2013.01); *B65D 2519/00273* (2013.01); *B65D 2519/00288* (2013.01); *B65D 2519/00318* (2013.01)

(58) Field of Classification Search
CPC ..... B65D 15/24; B65D 19/0012; B65D 2519/00273; B65D 2519/00288; B65D 2519/00318; B65D 15/22; B65D 43/02
USPC ..... 206/386, 600; 220/4.28, 4.31, 4.33, 6, 7
See application file for complete search history.

(56) References Cited

U.S. PATENT DOCUMENTS 3,315,639 A * 4/1967 Close ..... B05B 15/1214 118/320
3,784,043 A * 1/1974 Presnick ..... B65D 88/528 220/4.28
6,808,074 B1 * 10/2004 Schwartz ..... A47F 3/005 206/577
7,240,799 B2 * 7/2007 Zhang ..... B65D 88/129 206/600
2007/0102315 A1 * 5/2007 Garcia De Alba .... B65D 19/10 206/386
2009/0032530 A1 * 2/2009 Chu ..... B65D 88/121 220/4.28

* cited by examiner

*Primary Examiner* — Steven A. Reynolds
(74) *Attorney, Agent, or Firm* — Allen Dyer Doppelt & Gilchrist

(57) ABSTRACT

A crate includes a base and an enclosure extending upwardly from the base defining a storage volume. A setback is defined around the enclosure such that a gap exists between corresponding sides of the base and the enclosure. The enclosure utilizes a lightweight, modular construction allowing the crate to be repeatedly assembled and disassembled for use and storage, and to allowing an enclosure storage volume to readily re-dimensioned as needed.

16 Claims, 9 Drawing Sheets

SHIPPING CRATE

CROSS-REFERENCE TO RELATED APPLICATION

This application claims the benefit of U.S. Provisional Patent Application Ser. No. 62/163,551, filed on May 19, 2015, the contents of which are herein incorporated by reference in their entirety.

FIELD OF THE INVENTION

The present invention relates to shipping crates and to systems and methods for the assembly thereof.

BACKGROUND OF THE INVENTION

Shipping crates are widely used to contain and protect goods during transit and storage. The typical shipping crate is constructed from wood, with a palette forming or being attached to a lower surface thereof. Movement of the crates is frequently accomplished using a forklift, with the forks inserted through clearances in the pallet or base.

While there some standard crate sizes, often crates are built to a custom size to house particular contents, and destroyed when no longer required. Shipping crates, even when reused, are often subject to rough handling and will eventually require replacement.

Sometimes crated goods are shipped with the intention of being re-crated and re-shipped. Scenery and equipment for travelling stage shows, travelling art exhibits, and leased equipment are but a few examples. In the case of such goods, the crates must be stored after unloading at each destination to remain available for reuse.

While typical shipping crates have been effectively used for many, many years, further improvements are possible.

SUMMARY OF THE INVENTION

In view of the foregoing, it is an object of the present invention to provide an improved shipping crate and related methods of assembly and use.

According to an embodiment of the present invention, a crate comprises a base and an enclosure extending upwardly from the base defining a storage volume. According to one aspect of the present invention, a setback is defined around the enclosure such that a gap exists between corresponding sides of the base and the enclosure. According to another aspect of the present invention, the enclosure utilizes a lightweight, modular construction allowing the crate to be repeatedly assembled and disassembled for use and storage, and to allowing an enclosure storage volume to readily re-dimensioned as needed.

These and other objects, aspects and advantages of the present invention will be better appreciated in view of the drawings and following detailed description of preferred embodiments.

DETAILED DESCRIPTION OF PREFERRED EMBODIMENTS

Figure 1:
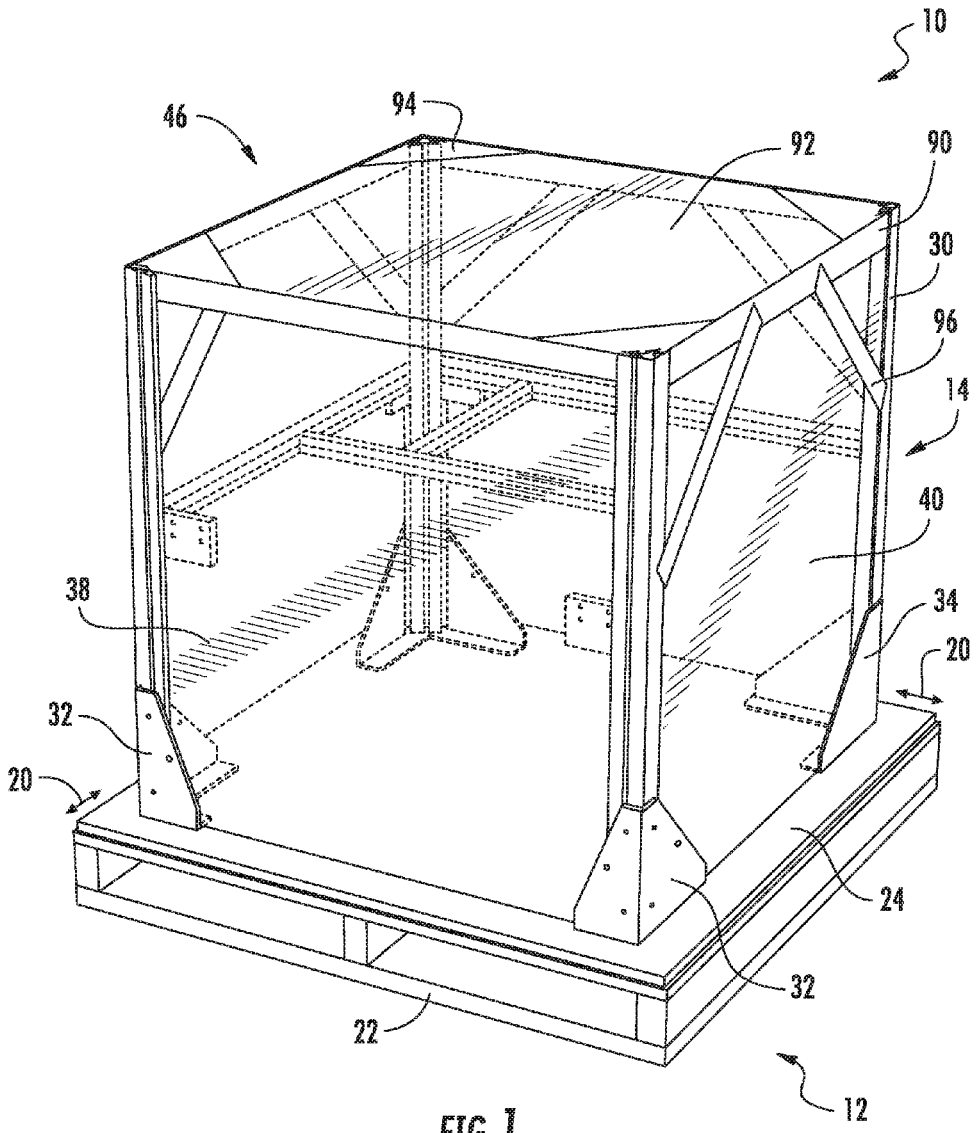
FIG. 1 is a perspective view of a crate, according to an embodiment of the present invention.
Figure 2:
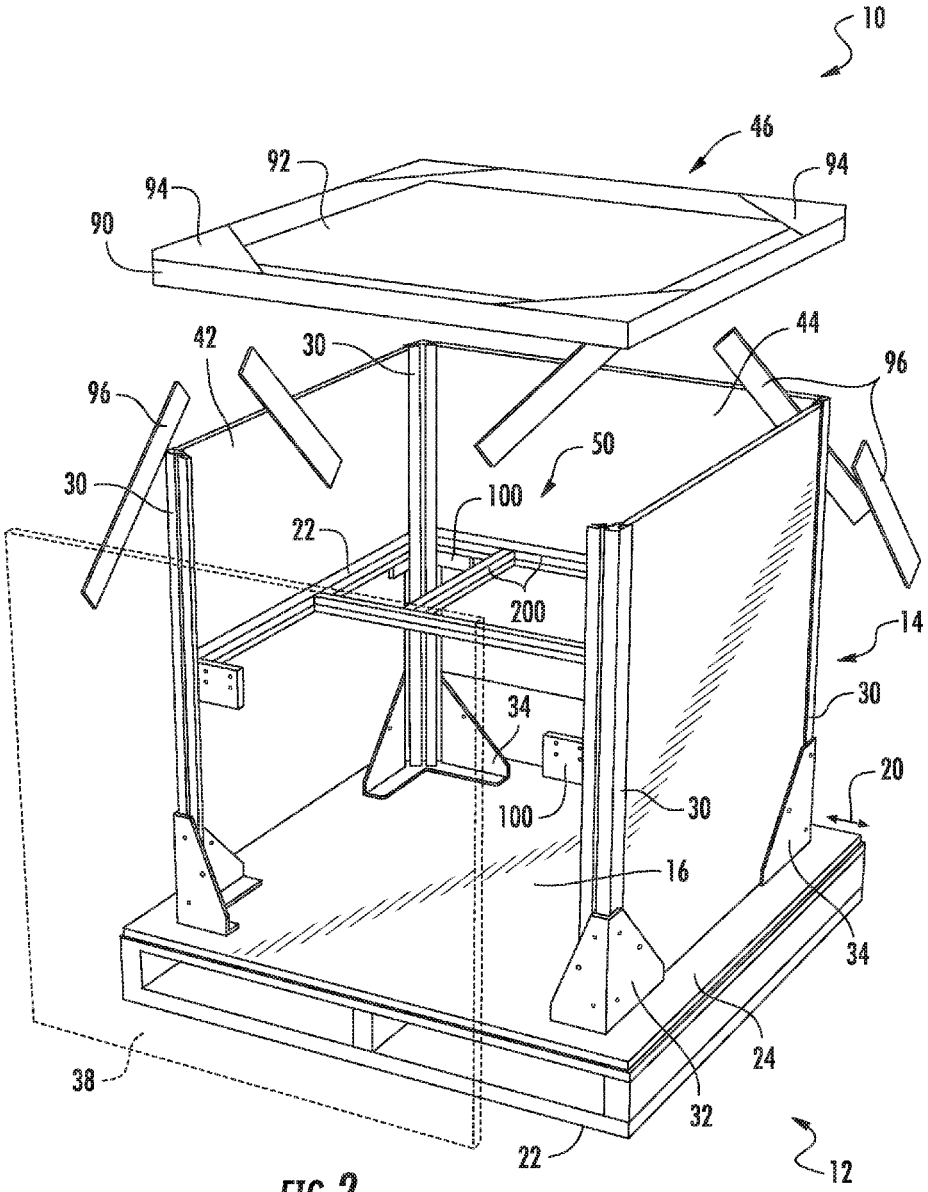
FIG. 2 is a partially exploded perspective view of the crate of FIG. 1.

Referring to FIGS. 1 and 2, according to an embodiment of the present invention, a crate 10 includes a base 12 having an enclosure 14 extending upwardly therefrom defining a storage volume 16. The enclosure 14 is advantageously of lightweight, modular construction, reducing the weight of the crate 10 and allowing the crate 10 to be broken down and stored between uses. A setback 20 is defined around the enclosure 14, creating a gap between corresponding sides of the base 12 and the enclosure 14, which minimizes the risk of damage to the enclosure 14—particularly during forklift handling of the crate 10.

The base 12 includes a pallet 22 and a cover panel 24. The pallet 22 is preferably made of wood, and can be of conventional pallet design. The cover panel 24 is preferably plywood or the like and is screwed, nailed or otherwise attached to the top of the pallet 22 to provide a solid, flat surface for mounting of the enclosure 14. A pallet formed integrally with a cover panel could also be used, although the connection of separate elements allows more readily for the use of conventional pallets, as well as the separate replacement of the pallet in case of damage thereto.

While conventionally constructed enclosures could be used with the base 12 incorporating the setback 20, the enclosure 14 is advantageously of lightweight, modular construction. The enclosure 14 includes corner posts 30, corner brackets 32, 34, side panels 38, 40, 42, 44, a lid assembly 46 and internal framework 50. These components are all disconnectable to allow breakdown and storage of the enclosure 14 in a small volume relative to the storage volume 16 defined by the assembled enclosure 14.

Figure 3:
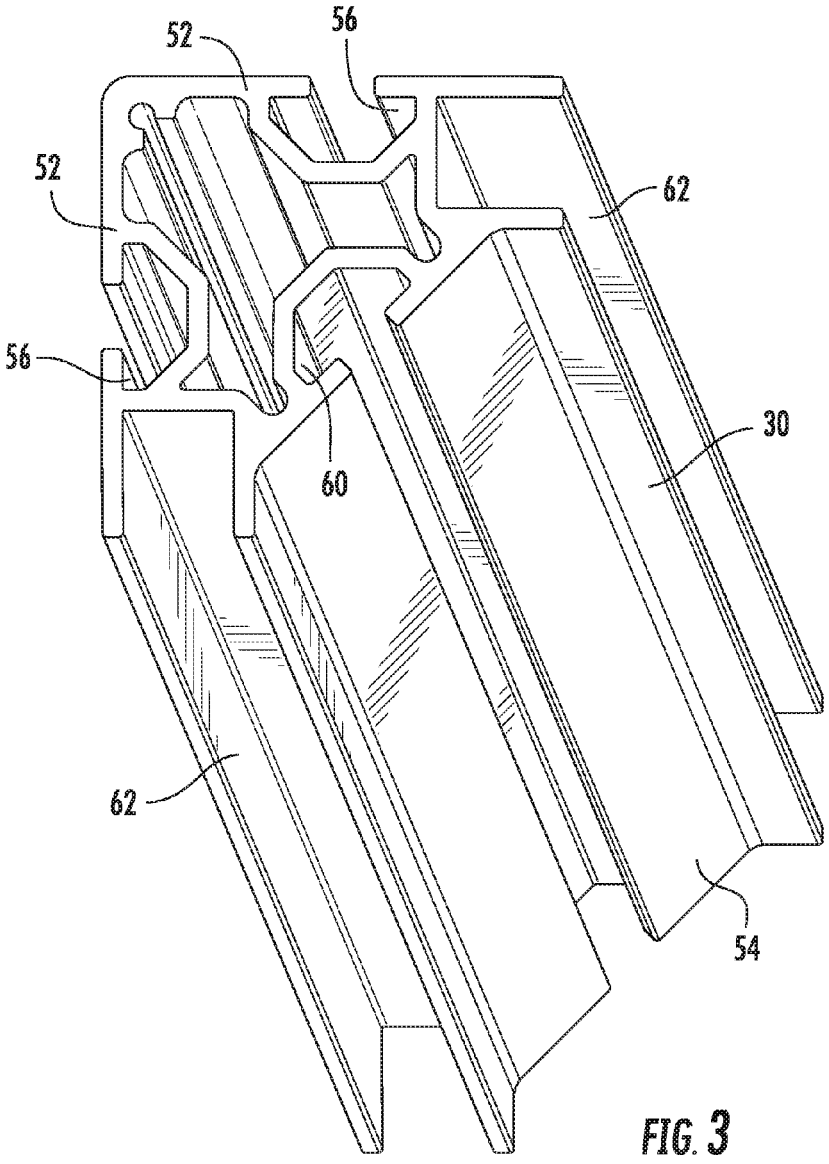
FIG. 3 is a perspective view of a corner post of the crate of FIG. 1.

Each corner post 30 is preferably substantially identical. Referring to FIG. 3, showing an illustrative portion of a corner post 30, each post 30 includes outer walls 52 and an inner wall 54. In the depicted embodiment, the outer walls 52 are approximately perpendicular with the inner wall 54 being at a 45 degree angle to each outer wall 52; however corner posts with other wall geometries could be employed to accommodate non-rectangular enclosures.

Outer mounting slots 56 are defined in each of the outer walls 52 and an inner mounting slot 60 is defined in the inner wall 54. Panel slots 62 are defined between the outer walls 52 and each end of the inner wall 54. The mounting slots 56, 60 accommodate brackets for attaching components to the outside or inside of the crate 10, as will be explained in greater detail below. The panel slots 62 accommodate some or all of the side panels 38, 40, 42, 44 (in the depicted embodiment, the side panels 40-44 are accommodated in panel slots 62 of adjacent corner posts 30, and the panel 38 is bolted to the outside of adjacent corner posts 30 via outer mounting slots 56).

The profile of the corner posts 30 is well suited for extrusion, and corner posts 30 made of an extruded metal, like aluminum, or an extruded polymer are preferred. However, the corner posts 30 could be made using other manufacturing methods and made out of any suitably strong and durable material.

The length of the corner posts 30 effectively defines the height of the enclosure 14. Thus, the corner posts 30 could be made in, or cut to, any desired length based on desired dimensions of the enclosure 14. Similarly, by simply swapping out different length corner posts 30, the same base 12, corner brackets 32, 34 and lid assembly 46 could be re-used in the same configuration to create enclosures of different heights and volumes.

The corner brackets 32, 34 mount to the cover panel 24 of the base 12, defining the footprint of the enclosure 14 and connecting to lower ends of respective corner posts 30. Although substantially identical corner brackets 32, 34 could be used, the depicted embodiment the corner brackets 32 adjacent to the side panel 38, are somewhat different in design than the corner brackets 34 adjacent to the side panel 44.

Figure 4:
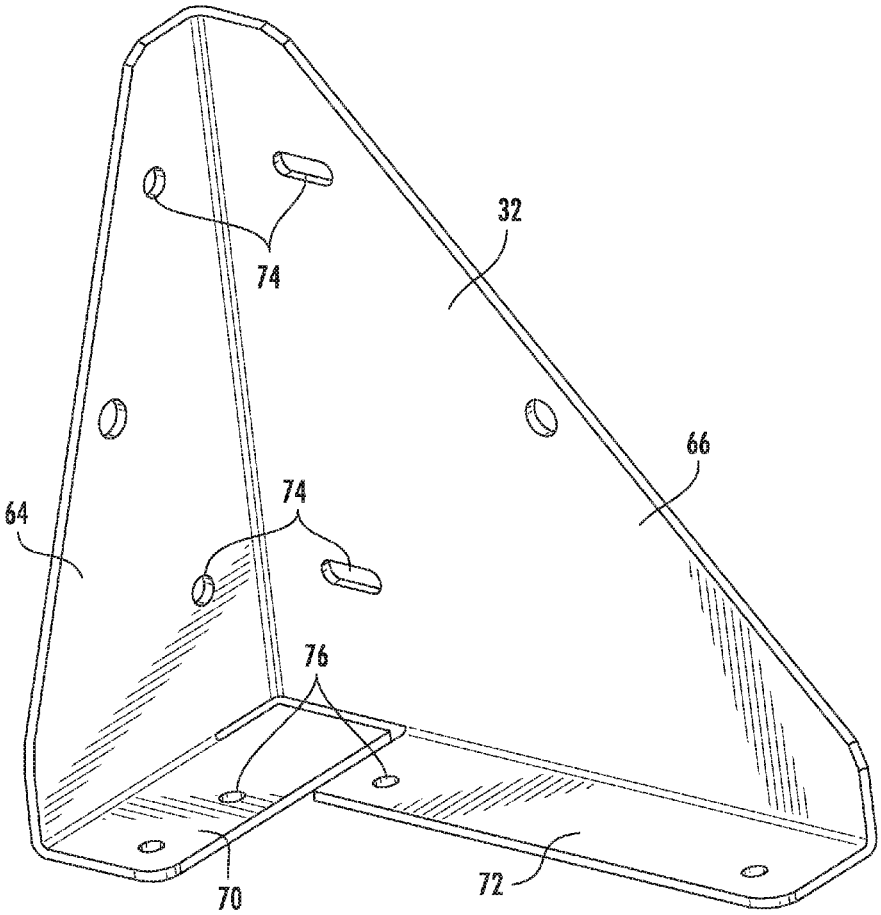
FIG. 4 is a perspective view of a corner bracket of the crate of FIG. 1.

Referring to FIG. 4, one of the corner brackets 32 is shown, with the other corner bracket 32 being a mirror image thereof. Each bracket 32 includes angled side walls 64, 66 and base walls 70, 72. Corner post mounting holes 74 are defined in the side walls 64, 66 and base mounting holes 76 are defined in the base walls 70, 72. On each of the brackets 32, the side wall 64 (which is parallel with the side panel 38) is less wide than the side wall 66. This allows a broader entrance into the enclosure 14 when the side panel 38 is removed.

Figure 5:
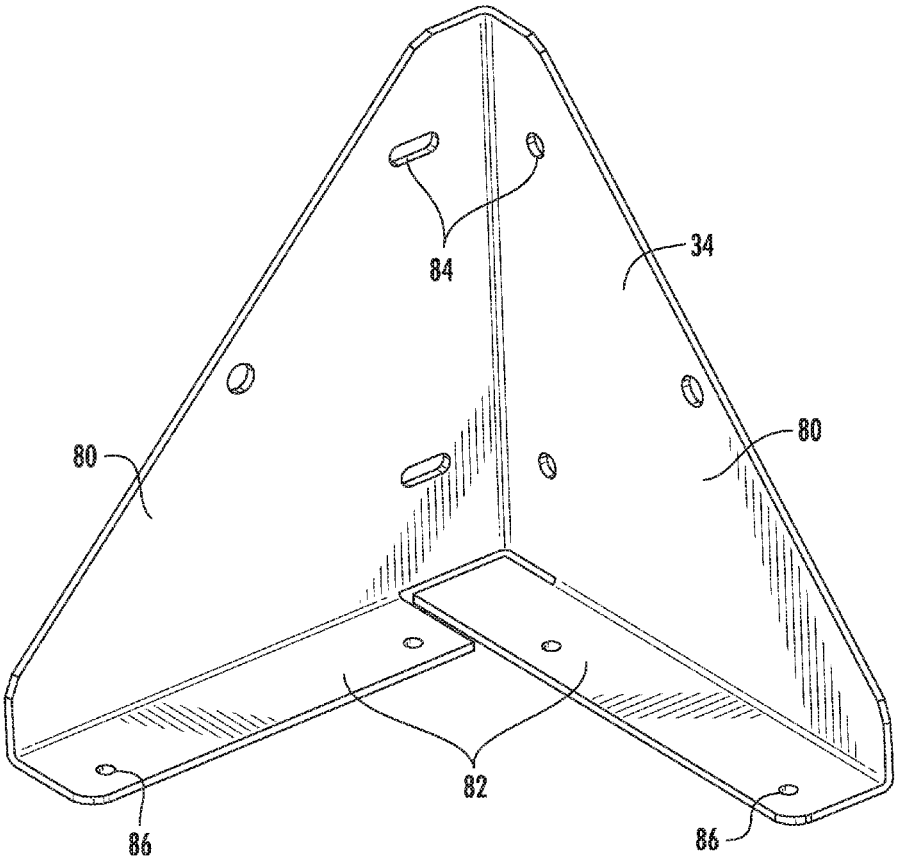
FIG. 5 is a perspective view of another corner bracket of the crate of FIG. 1.

Referring to FIG. 5, the corner brackets 34 each include angled side walls 80, base walls 82 and mounting holes 84, 86. Essentially, the corner brackets 34 are identical to the corner brackets 32 except the angled side walls 80 of the brackets 34 are of approximately equal width.

The corner brackets 32, 34 are preferably made of metal or other sufficiently strong material. Aluminum is a particularly suitable metal choice. The brackets 32, 34 can advantageously be formed by stamping and folding from a single metal sheet.

Referring again to FIGS. 1 and 2, the side panels 38, 40, 42, 44 are advantageously made of a strong, lightweight polymer material, such as polycarbonate hurricane panel materials. Metal, wood and other materials could also be used, if desired.

The side panels 38, 40, 42, 44 are cut to fit between adjacent corner posts 30. The height of the panels 38, 40, 42, 44 can match the enclosure 14 height, or two or more panel sections can be stacked to achieve the necessary height (as is the case with the depicted panels 40, 42, 44, which are each composed two stacked sections). As discussed above, the panels 40, 42, 44 are preferably accommodated in the panel slots 62 of their adjacent corner posts 30, while the side panel 38 is bolted to the outside of its adjacent corner posts 30, with the resulting quick removal allowing it to serve as a door in the enclosure 14 without removal of the lid assembly 46.

The lid assembly 46 has a perimeter frame 90 covered by a lid panel 92. Corner pieces 94 reinforce the perimeter frame 90 at corners thereof. The perimeter frame 90 is dimensioned to fit closely over the tops of the corner posts 30. Braces 96 are bolted between the perimeter frame 90 and the corner posts 30 outside the side panels 40, 42, 44, which add rigidity to the enclosure 14 and secure the lid assembly 46 thereto. Additionally, the perimeter frame 90 can be bolted directly to the corner posts 30.

The perimeter frame 90 and corner pieces 94 are preferably metal, such as aluminum, or other strong, rigid material. The lid panel 92 is advantageously made of the same material as the side panels 38, 40, 42, 44.

When wishing to secure items to a particular location within a conventional wooden crate, it is easy to screw fittings into the wood sides of the crate. However, the inner mounting slots 60 in the corner posts 30 allow enhanced flexibility to securely place internal framework 50 inside the enclosure 14. Internal corner brackets 100 bolt to the corner posts 30 via the slots 60 and a desired configuration of interior frame pieces 102 can then be attached to the brackets 100 and to each other. In addition to creating frame areas in which loose items can be securely restrained, shelves or the like can be placed on the interior frame pieces 102, allowing multiple levels of storage within the storage volume 16.

Figure 6:
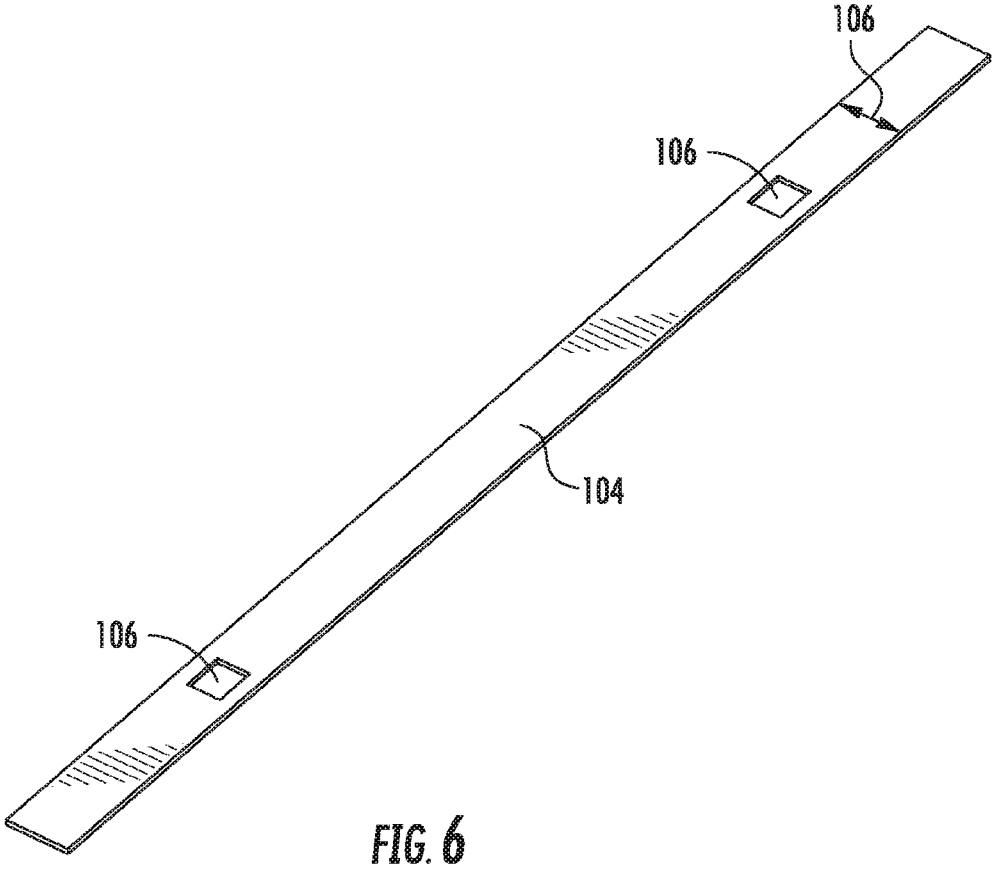
FIG. 6 is a perspective view of a carriage bolt keeper used in connection with the corner post of FIG. 3.

Various means can be employed to make connections between the corner posts 30 and the other enclosure 14 components. Referring to FIG. 6, a carriage bolt keeper 104 has a width 106 to fit closely within the mounting slots 56, 60 of the corner posts 30, with carriage bolts extending outwardly therefrom through the openings 106. The bolts extend through openings in the brackets 32, 34, 100, side panel 38, braces 96 and the like and are secured by nuts. A similar bolt keeper can also be used within slots of the interior frame pieces 102. While other connections means are possible, the use of slidable keepers 104 allows connections to be made at any desired point along posts 30 or frame pieces 102, permitting a very high degree of design flexibility.

Figure 7:
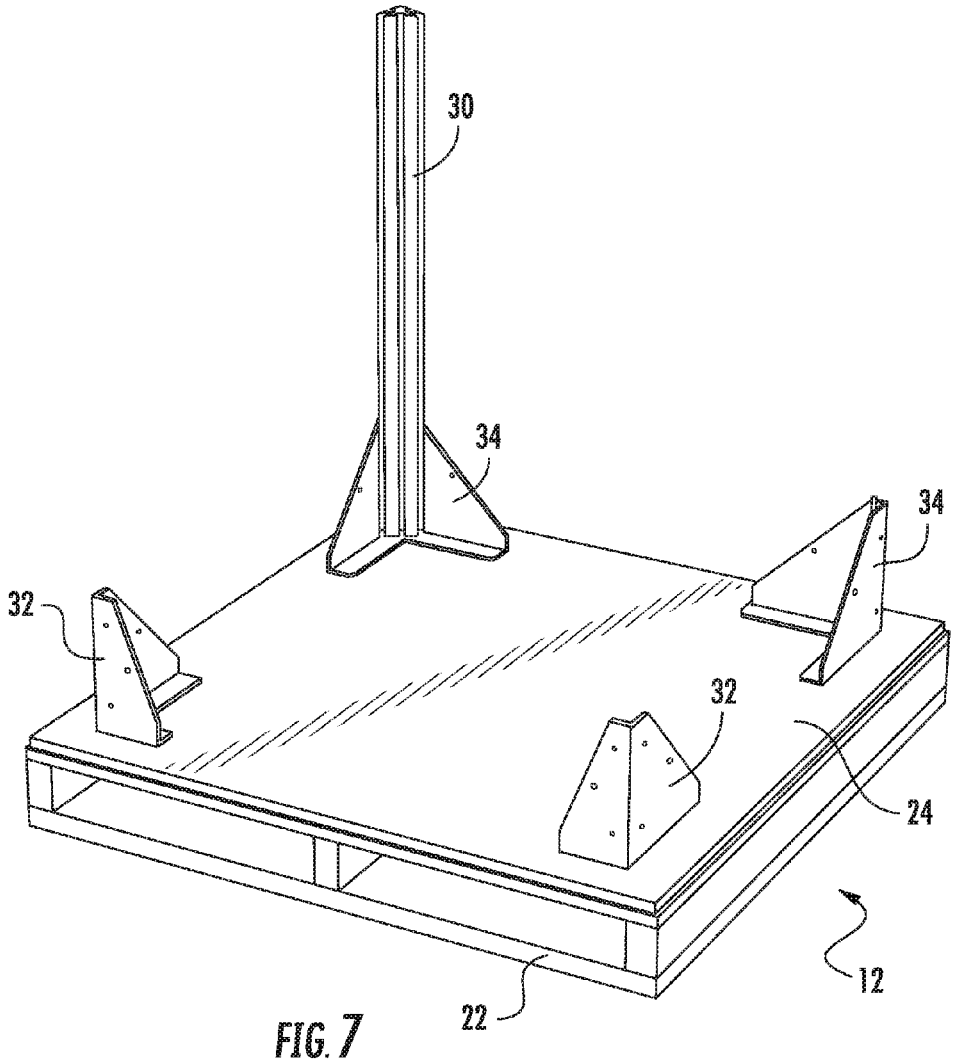
FIGS. 7-9 are perspective views of the crate of FIG. 1, during stages of assembly.
Figure 8:
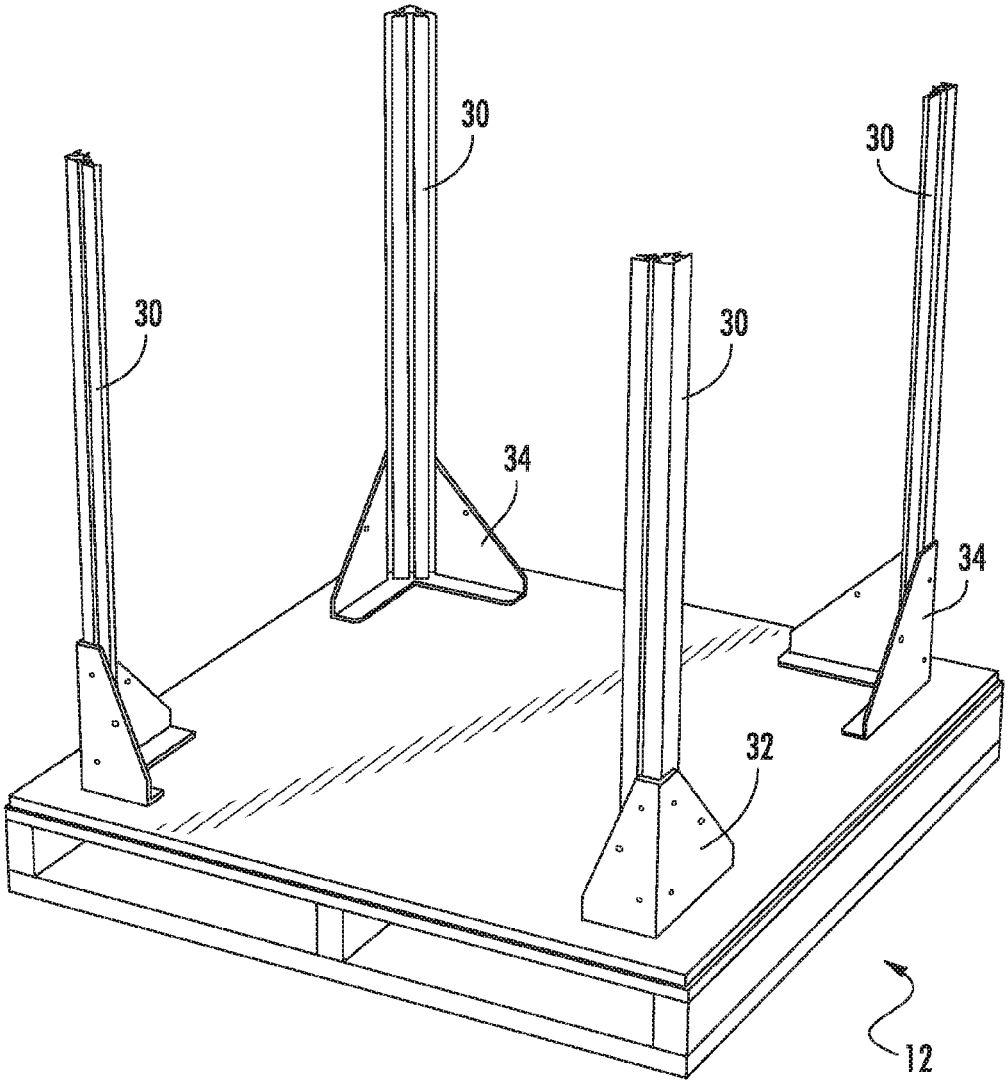
Figure 9:
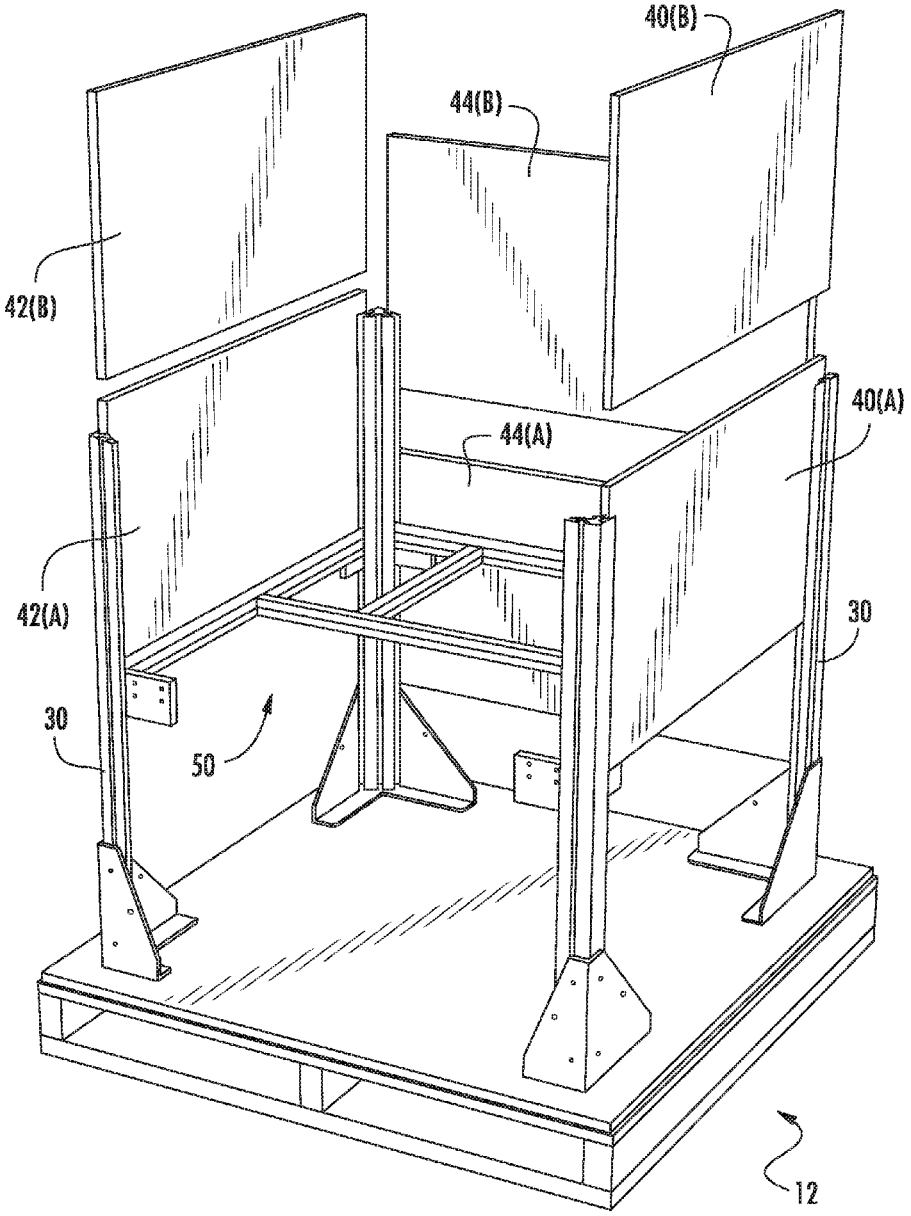

Referring to FIG. 7, during assembly of the crate 10, the corner brackets 32, 34 are attached to the cover panel 24 of the base 12, which can be done before or after the cover panel 24 is attached to the pallet 22. Referring also to FIG. 8, the corner posts 30 are then secured to the corner brackets 32, 34. Referring to FIG. 9, any desired internal framework 50 is secured to the corner posts 30, and the side panels 40, 42, 44 are lowered into the panel slots 62 (see FIG. 3) of their adjacent corner posts 30.

As a can be seen in FIG. 9, the side panels 40, 42, 44 in the depicted embodiment are each composed of lower (A) and upper (B) panel sections, which facilitates installation and also allows greater modularity. For instance, if an enclosure of only half the height were desired, then only the lower (A) panel sections would be used with shorter corner posts.

Referring to FIG. 2, the lid assembly 46 is then placed over the corner posts 30 and side panels 40, 42, 44, and the braces 96 are secured. At this point, the crate 10 can be loaded with goods. Once loading is complete, the side panel 38 is secured to the outside of its adjacent corner posts 30 and the crate 10 is ready for shipping, as seen in FIG. 1.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A crate comprising:

a base;

an enclosure extending upwardly from the base defining a storage volume and wherein the enclosure includes four corner posts with four side panels removably received therebetween to define sides of the storage volume;

a lid assembly releasably attached to upper ends of the four corner posts; and wherein three of the four side panels are each slidably received in panel slots of adjacent corner posts, and a fourth of the four side panels is releasably connected to outside surfaces of adjacent corner posts; and wherein the fourth of the four side panels is configured to be disconnected from the outside surfaces of adjacent corner posts without removal of the lid assembly; and wherein a setback is defined around the enclosure such that a gap exists between corresponding sides of the base and the enclosure.

2. The crate of claim 1, wherein the base includes a pallet.

3. The crate of claim 2, wherein the base further includes a cover panel attached to the top of the pallet, the enclosure being mounted to the cover panel.

4. The crate of claim 3, wherein the cover panel is solid and flat.

5. The crate of claim 4, wherein the cover panel is plywood.

6. The crate of claim 1, wherein the enclosure further includes four corner brackets, each of the corner brackets releasably connecting a respective one of the four corner posts to the base.

7. The crate of 1, wherein the three side panels slidably received in the panel slots of adjacent corner posts each include first and second side panel sections, each second side panel section being slidably received in the panel slots on top of a respective one of the first side panel sections.

8. The crate of claim 1, wherein the three side panels slidably received in the panel slots of adjacent corner posts cannot be removed therefrom without removal of the lid assembly.

9. The crate of claim 1, where each of the corner posts has an inner wall facing into the storage volume, a vertically-extending inner mounting slot being defined in the inner facing wall of each of the corner posts.

10. The crate of claim 9, wherein the enclosure further includes internal framework releasably secured to the inner mounting slot of at least one of the corner posts.

11. A crate comprising:

a base;

an enclosure extending upwardly from the base defining a storage volume, the enclosure including a plurality of corner brackets connected to the base;

a plurality of corner posts, each of the plurality of corner posts being releasably connected to a respective one of the plurality of corner brackets and extending upwardly from the base;

a plurality of side panels, each of the plurality of the side panels being slidably received in panel slots of respective pairs of the plurality of corner posts to form sides of the enclosure; and a lid assembly releasably connected to tops of the plurality of corner posts; and wherein another side panel is releasably connected to outsides of a respective pair of the plurality of corner posts to form another side of the enclosure that can be connected and removed without removal of the lid assembly.

12. The crate of claim 11, wherein the plurality of corner brackets is each separated from a respective corner of the base such by a gap such that a setback is defined around the sides of the enclosure.

13. The crate of claim 11, wherein the lid assembly is releasably connected to the tops of the plurality of corner posts by a plurality of braces extending between the plurality of corner posts and a perimeter frame of the lid assembly.

14. The crate of claim 11, wherein the plurality of side panels are polycarbonate panels.

15. The crate of claim 11, wherein the corner posts are aluminum.

16. The crate of claim 11, wherein each of the corner posts is an extruded unitary piece.

* * * * *